United States Patent [19]

Liesener

[11] 4,124,333

[45] Nov. 7, 1978

[54] EXTERNALLY ADJUSTABLE LOAD PLUS PUMP CONTROL ASSEMBLY

[75] Inventor: Kenneth P. Liesener, Joliet, Ill.

[73] Assignee: Caterpillar Tractor Co., Peoria, Ill.

[21] Appl. No.: 841,427

[22] Filed: Oct. 12, 1977

[51] Int. Cl.[2] ..... F04B 49/00

[52] U.S. Cl. ..... 417/218; 60/445; 60/452; 417/222

[58] Field of Search ..... 417/218–222; 60/445, 452

[56] References Cited

U.S. PATENT DOCUMENTS

| | | | |
|---|---|---|---|
| 3,350,881 | 11/1967 | D'Amato | 417/222 |
| 3,797,245 | 3/1974 | Hein | 60/452 |
| 4,028,890 | 6/1977 | Habiger et al. | 417/218 X |
| 4,034,564 | 7/1977 | Johnson et al. | 60/452 X |
| 4,074,529 | 2/1978 | Budzich | 60/452 X |

*Primary Examiner*—William L. Freeh
*Assistant Examiner*—Edward Look
*Attorney, Agent, or Firm*—John W. Grant

[57] ABSTRACT

A pump control assembly for a variable displacement pump has a means connected to a spring for selectively adjusting the preload on the spring for selectively adjusting the minimum pump discharge pressure. An adjustable stop device is provided for selectively adjusting the maximum force exerted on the spring by a piston device which increases the load on the spring for increasing the pump discharge pressure in response to a load pressure signal exceeding a preselected pressure level.

3 Claims, 3 Drawing Figures

EXTERNALLY ADJUSTABLE LOAD PLUS PUMP CONTROL ASSEMBLY

BACKGROUND OF THE INVENTION

This invention relates to a load plus pump control and more specifically to means for externally adjusting the minimum and maximum pump discharge pressures.

Some pump controls have the so-called load plus control function in which the pump discharge pressure is maintained at a higher level than the load pressure. Such controls commonly have a spring for exerting a biasing force on a valve and a load piston to increase the load on the spring in response to an increase in the load pressure. The preload on the spring is fixed at a preselected force for establishing the minimum pump discharge pressure while a fixed stop is provided to limit the maximum load on the spring to establish the maximum pump discharge pressure.

One problem encountered with such controls is that of setting the preload on the spring during assembly. Due to normal manufacturing tolerances, the preload on the spring in the assembled pump control may vary from one pump control to another. The normal manufacturing practice is to assemble the controls with several shims beneath the spring, operate the pump and measure the minimum and maximum pump discharge pressures. If either the minimum or maximum pump discharge pressure is not within the acceptable range, the pump controls must be disassembled and shims added or removed accordingly. The pump controls are commonly disassembled at least once and frequently several times before the preload on the spring is within acceptable limits. Such disassembling and reassembling of the pump control to adjust the preload on the spring is both time consuming and adds to the overall cost of manufacturing the pump control assembly.

SUMMARY OF THE INVENTION

The present invention is directed to overcoming one or more of the problems as set forth above.

According to the present invention, a pump control assembly for moving a swash plate of a variable displacement pump between maximum and minimum discharge displacement positions has a first means for controlling the position of the swash plate. The first means has an actuating means connected to the swash plate and a valve member which has first and second end portions and is movable between a first position at which a pump discharge pressure signal is communicated to the actuating means and a second position at which said pump discharge pressure signal is blocked from communication with the actuating means and the actuating means is in communication with a drain. The first end portion of the valve member has an end being always exposed to said pump discharge pressure signal and being responsive thereto for biasing the valve member toward one of the first and second positions. A spring has first and second ends with said first end being connected to said second end portion of the valve member. A means is connected to the second end of the spring for selectively adjusting the preload on the spring for selectively adjusting the minimum pump discharge pressure. A piston means increases the preload on the spring for increasing the pump discharge pressure in response to a load pressure signal exceeding a preselected pressure level. An adjustable stop means selectively adjusts the maximum force exerted on the spring by the piston means.

DETAILED DESCRIPTION

Figure 1:
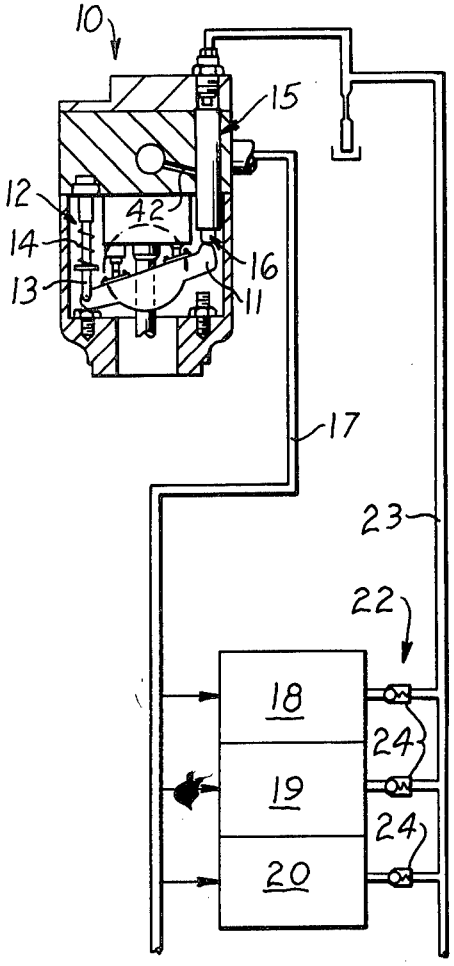
FIG. 1 is a diagrammatic view of an example hydraulic system having the externally adjustable load plus pump control of this invention.
Figure 2:
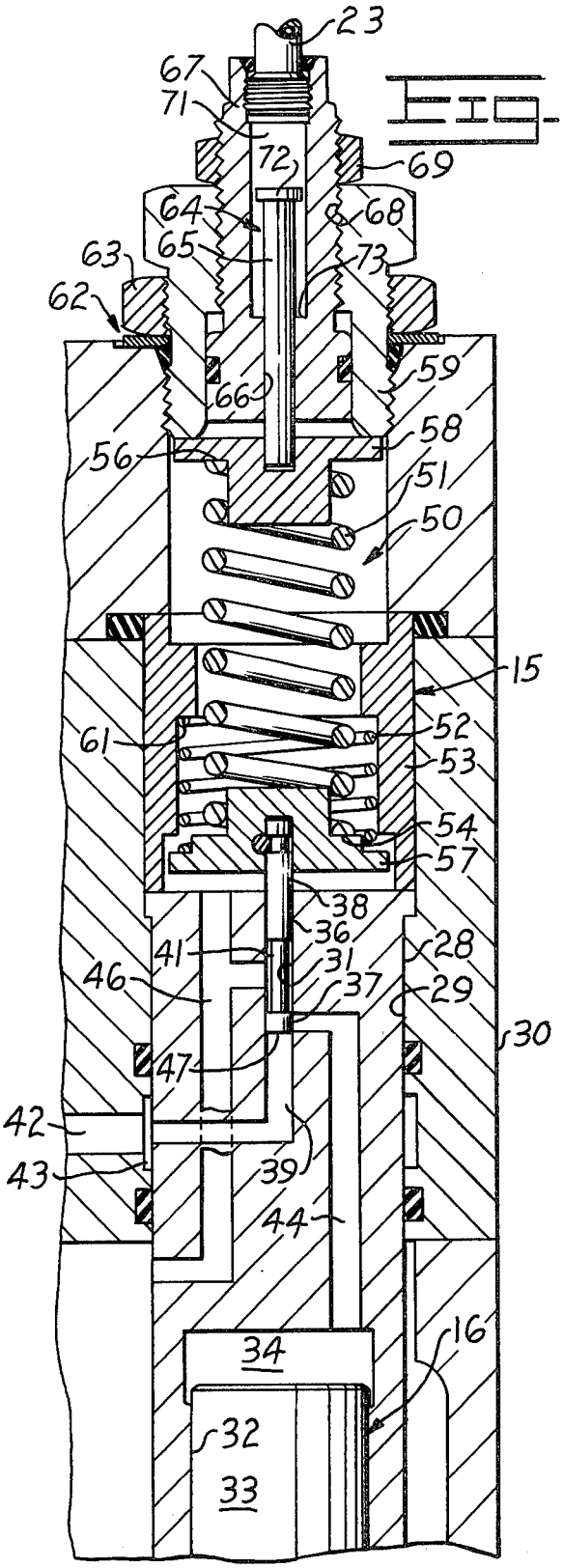
FIG. 2 is a diagrammatic enlarged partial sectional view of the pump control.

Referring to FIG. 1, a variable displacement pump 10 has a swash plate 11 that is movable between first and second positions for varying the discharge rate of the pump between maximum and minimum. The pump includes a means 12 having a movable actuator 13 and a spring 14 for biasing the swash plate in a first direction toward the maximum displacement output position and a means 15 for controlling the position of the swash plate and hence the pump discharge pressure in response to the pump discharge pressure and the load pressure. The means 15 has an actuating means 16 connected to the swash plate for biasing the swash plate to a reduced displacement output position.

Discharge of the pump 10 is delivered by a line 17 to a plurality of working elements 18, 19, 20, for the operation thereof. Means 22 is provided for sensing the operating pressure of the work elements and passing the largest of said pressures as a single load pressure signal through a line 23. The means 22 can be, for example, a plurality of check valves 24 commonly oriented and each being connected to a respective work element 18, 19, 20 and to line 23.

Such a pump control system is well known in the art and further description will be limited for purposes of brevity.

The means 15 has a housing member 28 which is positioned within a stepped bore 29 of a pump housing 30 and has a pair of concentric bores 31, 32 therein. The actuating means 16 includes a piston 33 slidably positioned within the bore 32 forming an actuating chamber 34 at the closed end of the bore. A lower end of the piston is connected to the swash plate (FIG. 1). An elongated valve member 36 has first and second end portions 37, 38. The first end portion is slidably positioned within the bore 31 forming an actuating chamber 39 therein. A reduced diameter portion 41 is provided on the first end portion of the valve member.

The valve member 36 is movable between first and second positions. At the first position, a pump discharge pressure signal passes from a discharge passage through a passageway 42, a port 43 in the housing member connecting the passageway with the actuating chamber 39, and a port 44 connecting actuating chambers 39 and 34. At the second position of the valve member, the pump discharge signal is blocked from communication with the port 44 and hence the actuating chamber 34 is in communication with a drain port 46 via the port 44 and the reduced diameter portion 41. The pump discharge signal is always present in the actuating chamber 39 and thus is always exposed to an end 47 of the first end portion 37 of the valve member 36. Thus, fluid pressure acts on the effective area of the end 47 for biasing the valve member toward the first position.

A spring means 50 biases the valve member 36 toward the second position in opposition to the biasing force exerted on the valve member by the pump discharge signal in the actuating chamber 39 and establishes a preselected minimum discharge pressure of the pump.

The spring means 50 can be, for example, first and second compression springs 51, 52 concentrically positioned within a housing member 53 positioned within the bore 29 of the pump housing 30. The first spring is positioned between and has first and second ends 54, 56 connected to first and second spring retaining elements 57, 58. The first spring retaining element 57 is connected to the second end portion 38 of the valve member 36 while the second retaining element 58 is positioned for abutment with a housing member 59. The second spring 52 has an end seated on the first spring retaining element 57 and its opposite end in abutment with an annular shoulder 61.

In the assembled condition of the apparatus shown, both the first and second springs 51, 52 are maintained in a preloaded condition for biasing the valve member 36 toward the second position. A means 62 for selectively adjusting the preload on the first spring 51 includes the member 59 which is threadably connected to the pump and a lock nut 63 for locking the member 59 in an adjusted position.

A piston means 64 is provided for increasing the biasing force of the first spring 51 on the valve member 36 to increase the pump discharge pressure in response to a load pressure signal in line 23 exceeding a preselected pressure level. The means 64 can be a load pressure piston 65 slidably positioned within a bore 66 of a member 67 threaded into a threaded bore 68 of the member 59. A lock nut 69 locks the member 67 in an adjusted position relative to the member 59.

One end of the load pressure piston 65 is connected to the second spring retaining element 58 while the other end is positioned wthin an actuating chamber 71. Thus, the spring 51 is considered to be in series relationship between the load pressure piston and the valve member 36. The spring 52 acts in parallel to the spring 51. The line 23 is in continuous communication with the actuating chamber 71 for passing the load pressure signal into the actuating chamber. An enlarged flange portion 72 on the second end of the load piston is positioned for engagement with an annular shoulder 73 for limiting the maximum force exerted on the first spring 51 by the load piston 65.

Preferably, the diameter of the piston 65 is equal to the diameter of the first end portion 37 of the valve member 36. Thus, the effective area of the piston 65 exposed to the load pressure signal in the actuating chamber 71 is equal to the area of the end 47 of the valve member 36 exposed to the pump discharge pressure signal in the actuating chamber 39.

In the operation of the apparatus, at start up, the spring 14 biases the swash plate 11 to the maximum displacement output position shown. With the fluid flow through line 17 blocked or otherwise restricted, operation of the pump causes the fluid to pressurize in the discharge passage and thus the actuating chamber 39 sufficiently to overcome the force of springs 51, 52 and move the valve member 36 toward the second position for communicating actuating chambers 39 and 34. The fluid passing from the actuating chamber 39 into the actuating chamber 34 acts on the piston 33 which causes the piston to move the swash plate 11 to a reduced displacement position. The system pressure will eventually balance with the biasing force exerted on the valve member when the pump discharge pressure in the actuating chamber 39 equals the biasing force of the springs 51, 52.

Figure 3:
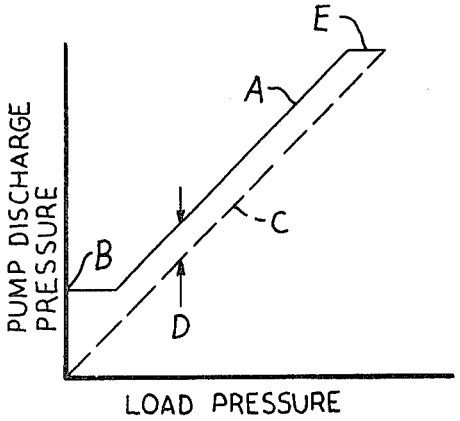
FIG. 3 is a graphical illustration of the pump discharge pressure/load pressure characteristics of the variable displacement pump utilizing the subject invention.

When there is no demand on the pump, that is if no load pressure signal is present in the line 23, the pump discharge pressure at the discharge passage 42 will be maintained at a preselected minimum level as established by the combined biasing force of both springs 51, 52. The pump discharge pressure is represented by the line A on the graph of FIG. 3 with the minimum discharge pressure level represented at point "B".

For adjusting the minimum pump discharge pressure a suitable pressure gauge is connected to line 17 and the lock nut 63 backed away from the pump housing 30. The member 59 is then rotated in the appropriate direction causing it to move longitudinally, thereby adjusting the preload on the spring 51. Adjsuting the preload on the spring 51 adjusts the minimum discharge pressure or point B of the pump.

From the balanced position described above, if the fluid demand of the working elements 18, 19, 20 increases, an increased load signal is delivered by line 23 to the actuating chamber 71. The load pressure signal is represented by the broken line "C" on the graph of FIG. 3. Initially, the load pressure signal in the actuating chamber 71 is insufficient to overcome the bias of the springs 51 and thus the pump discharge pressure will be maintained at the minimum pressure level as the load pressure signal increases until the load pressure reaches a preselected pressure level. At this time, the increased load pressure signal drives the piston 65 toward the valve member 36, exerting a commonly directed force on the valve member through the spring 51, causing the valve member to be moved downwardly toward its second position. At the second position, communication between chambers 39 and 34 is blocked while the chamber 34 is communicated with the drain port 46. This allows the spring 14 and the swivel torques to bias the swash plate 12 toward the maximum displacement position in response to the increased load thereby causing the pump discharge pressure to increase proportional to the amount of increase in the load pressure signal.

As set forth above, the area of the piston 65 acted on by the load pressure signal in actuating chamber 71, is substantially equal to the area of the end 47 of the valve member 36 acted on by the pump discharge pressure in the actuating chamber 39. The second spring 52 provides a load plus function by exerting a substantially constant force on the valve member 36 independently of the force exerted by the first spring 51 and the piston 65. Thus, the pump discharge pressure is always above the load pressure and once the pump discharge pressure exceeds the preselected minimum pressure level, the pressure differential between the pump discharge pressure and the load pressure remains substantially constant at the higher pressure ranges. This pressure differential is represented at "D" on the graph of FIG. 3.

When the load pressure increases sufficiently, the enlarged flange of the load piston 65 engages the annular shoulder 73, thereby preventing further movement of the load piston toward the valve member 36 and thus limits the maximum force exerted on the spring by the load piston 65. This in turn establishes the maximum pump discharge pressure of the system. The maximum discharge pressure is represented at point "E" on the graph of FIG. 3. To adjust the maximum discharge pressure, the lock nut 69 is backed away from the member 59 and member 59 adjusted upwardly or downwardly by rotating member 59 in the appropriate direction. This in turn adjusts the position at which the flange portion 72 of the piston 65 engages the annular shoulder thereby adjusting the maximum force exerted on the spring 51 by the load piston 65. After the adjustment is completed, the lock nut is rotated into engagement with the member 59 for locking the member in the adjusted position. The maximum discharge pressure can be adjusted independently of and without affecting the adjustment of the minimum discharge pressure.

Alternatively, in some variable displacement pumps, the means 12 and 15 can be positioned wherein the actuator 13 and spring 14 biases the swash plate 11 toward the minimum displacement output position. The means 15 continues to control the position of the swash plate and hence the pump discharge pressure in response to the pump discharge pressure and the load pressure. In those pumps, the construction of valve member 36 and the position of the related ports from the discharge passage and the actuating chambers 34, 36 is also altered so that the valve member is biased to the position at which the pump discharge signal is blocked from communication with the actuating means 16 and the actuating means is in communication with the drain port 46 in response to the pump discharge pressure signal acting on the end 47 of the valve member.

Other aspects, objects and advantages of this invention can be obtained from a study of the drawings, the disclosure and the appended claims.

The embodiments of the invention in which an exclusive property or privilege is claimed are defined as follows:

1. In a pump control assembly for moving a swash plate of a variable displacement pump between maximum and minimum discharge displacement positions, said assembly having first means for controlling the position of the swash plate, said first means having an actuating means connected to the swash plate and a valve member having first and second end portions, said valve member being movable between a first position at which a pump discharge pressure signal is in communication with the actuating means and a second position at which said pump discharge pressure signal is blocked from communication with the actuating means and the actuating means in in communication with a drain, said first end portion of the valve member having an end substantially continuously exposed to the pump discharge pressure signal and being responsive thereto for biasing the valve member toward one of the first and second positions, the improvement comprising:

a spring connected to said valve member;

means for selectively adjusting the preload on the spring for selectively adjusting the minimum pump discharge pressure;

piston means for increasing the load on the spring for increasing the pump discharge pressure in response to a load pressure signal exceeding a preselected pressure level; and an adjustable stop means for selectively adjusting the maximum force exerted on the the spring by the piston means.

2. The pump control assembly of claim 1 wherein said means includes a first threaded member connected to the spring and being selectively adjustable relative to the valve member.

3. The pump control assembly of claim 2 wherein said piston means includes a piston having first and second end portions, said first end portion being connected to the spring, said adjustable stop means including a threaded bore in the first threaded member, a second threaded member positioned within the threaded bore and having a bore therein, said piston being slidably positioned within said bore and having an enlarged portion on the second end positioned for engagement with said second threaded member, said second threaded member being selectively adjustable relative to said first threaded member.

* * * * *